United States Patent [19]

Pierce

[11] Patent Number: 4,607,837

[45] Date of Patent: Aug. 26, 1986

[54] TENSION APPARATUS FOR FEEDER MACHINE

[75] Inventor: Bobby L. Pierce, Bixby, Okla.

[73] Assignee: Sandco, Inc., Tulsa, Okla.

[21] Appl. No.: 719,887

[22] Filed: Apr. 3, 1985

[51] Int. Cl.[4] ..... B65H 5/36

[52] U.S. Cl. ..... 271/273; 271/198; 271/275; 198/836; 226/186

[58] Field of Search ..... 271/198, 272, 273, 274, 271/264, 268, 277, 275; 198/627, 628, 836; 226/186, 187, 196, 181

[56] References Cited

U.S. PATENT DOCUMENTS

| | | | |
|---|---|---|---|
| 1,156,357 | 10/1915 | Freeman | 271/9 |
| 2,012,130 | 8/1935 | Kellogg | 226/196 |
| 2,484,196 | 10/1949 | Turrall et al. | 198/628 |
| 2,613,706 | 10/1952 | Smith | 226/186 |
| 3,942,789 | 3/1976 | Townshend | 226/177 |
| 4,369,959 | 1/1983 | Hornbuckle | 271/274 |
| 4,445,668 | 5/1984 | Sauber | 226/181 |

*Primary Examiner*—Bruce H. Stoner, Jr.
*Assistant Examiner*—James E. Barlow
*Attorney, Agent, or Firm*—William S. Dorman

[57] ABSTRACT

An improved pressure adjustment device for the intermediate conveyor system of a sheet feed machine wherein the conveyor system includes a plurality of spaced roller assemblies slidably mounted on a beam which is pivotally mounted to interior portions of the sheet feed machine, and wherein the roller assemblies include their own spring tensioning; comprising a tension bar extending between the interior portions and having an elongated slot therein, the tension bar being located in a position closely adjacent and forward of the pivot axis of the beam, a hollow channel member being mounted on the tension bar and having a lower opening therein, and an adjustment screw having an external head and being threadedly received in the upper portion of the channel member whereby the lower end of the screw passes through the slot and opening and downwardly against the beam to urge the beam downwardly about its pivot axis.

3 Claims, 5 Drawing Figures

TENSION APPARATUS FOR FEEDER MACHINE

BACKGROUND OF THE INVENTION

1. Field of the Invention

The present invention relates to a tension apparatus for a sheet feeder machine. More particularly, the present invention relates to an improved tension apparatus for providing spring pressure in the second conveyor system of an envelope feeder. The envelope feeder is of a type used in combination with certain types of offset printers.

2. Prior Art

It is common in the print industry to provide offset presses and printers with sheet feed machines. These sheet feed machines provide a more efficient means of loading individual sheets of material such as envelopes, book pages and the like into an output feed or delivery station. Heretofore, a stack of envelopes, for example, was placed on top of a printer elevator of an offset press from which the top sheet was lifted off the stack by means of suction cups to be fed into the printer. The procedure continued until the stack was exhausted, thus requiring manual replacement of a new stack onto the printer elevator. This manual replacement was time consuming and inefficient.

Feeder machines have been provided to eliminate the above costly waste of man hours. The feeders are provided with a horizontal feed tray or table which acts as an output station and which is received into the input station or printer elevator of the printer. The machines are also provided with their own sheet input station, so that the sheet material can be continually replenished during the printing operation without needing to stop either machine. A intermediate conveyor mechanism comprising a plurality of rollers or hold down assemblies is used to move a stream of sheets atop a conveyor belt toward the output delivery station of the feeder.

Currently, the above intermediate conveyor mechanism is provided with an apparatus to adjust the downward pressure against the stream of sheets. This is a desirable feature since the size and thickness of the envelopes, as well as the speed of the operation can vary. The above variations can require adjustments in the pressure. However, the current method used to adjust the mechanism is clumsy and inefficient. A spring tension arm, which is attached at one end to a spring, is located on a inner side wall of the feeder. The other end of the tension arm is rotatably mounted on a rod which provides pivotal mounting for the above mechanism. In order to provide the correct downward spring pressure, an operator must push down on the tension arm while simultaneously loosening or tightening a thumb screw at the top of a portion of the above mechanism. This adjustment requires that the feeder machine be turned off.

A preliminary search was conducted on the present invention, and the following U.S. Pat. Nos. were uncovered:

2,012,130, 2,613,706, 3,942,789, 4,163,550, 4,445,668.

A prior art reference, U.S. Pat. No. 4,369,959 to Hornbuckle, discloses a sheet feed machine which comprises a sheet input station that can be continually replenished, an inversion station to invert a stream of sheets onto a conveyor system, and an intermediate conveyor mechanism to move a stream of sheets along the conveyor system toward the output delivery station. The intermediate conveyor mechanism is provided with a tension spring arrangement mounted on the central roller assembly. The Hornbuckle patent does not disclose an apparatus to adjust the tension on the forward and rear roller assemblies.

Another prior art reference, U.S. Pat. No. 4,163,550 to Armstrong, discloses pressure rollers mounted on parallel rods above a conveyor belt. The pressure rollers are individually adjusted and are of the type used to move sheets along conveyor belts after the printing operation. The other above mentioned prior art patents are not anticipatory to the present invention. No prior art reference discloses a tension apparatus that provides a quick and efficient means for adjusting the tension or pressure of the overall intermediate conveyor mechanism. No prior art reference discloses a tension adjustment apparatus that can be employed without needing to turn off the feeder machine.

SUMMARY OF THE INVENTION

The present invention eliminates the cumbersome tension adjustment method employed on current feeder machines. The present invention provides a tension apparatus for the intermediate conveyor mechanism that can be adjusted while the envelope feeder is operating. The tension apparatus of the present invention also provides a means to adjust the overall pressure of the above conveyor mechanism.

An envelope feeder, for example, is provided with an intermediate conveyor mechanism which holds a stream of envelopes down on a belt. The envelopes are then fed into parallel spaced guide members at the forward or delivery end of the feeder. The intermediate conveyor system comprises a plurality of hold down or roller assemblies which are slidably mounted on a beam. The beam passes through a bracket which is pivotably mounted on a pivot rod. The pivot rod is disposed perpendicular to the beam and extends between the interior side plates of the feeder. Each roller assembly is provided with a plurality of spaced rollers and the central roller assembly is provided with its own downward spring tension by means of a coupling spring.

The tension apparatus of the present invention comprises a tension bar which is closely adjacent the pivot rod and is disposed parallel thereto. The tension bar is provided with a central opening or slot. A channel member, having a hollow rectangular cross section is mounted on the tension bar. The channel member is provided with an opening in its lower end which is disposed below the central slot of the tension bar. An adjustment screw, having an external head, is threadedly received in the upper end of the channel member. The lower end of the adjustment screw projects downwardly through the slot in the tension bar and against the upper surface of the beam.

The above screw exerts a downward pressure on the beam around the pivot axis provided by the pivot rod. By turning the screw, the tension or pressure on the front and rear roller assemblies can be quickly and easily adjusted.

DETAILED DESCRIPTION OF THE PREFERRED EMBODIMENTS

Figure 1:
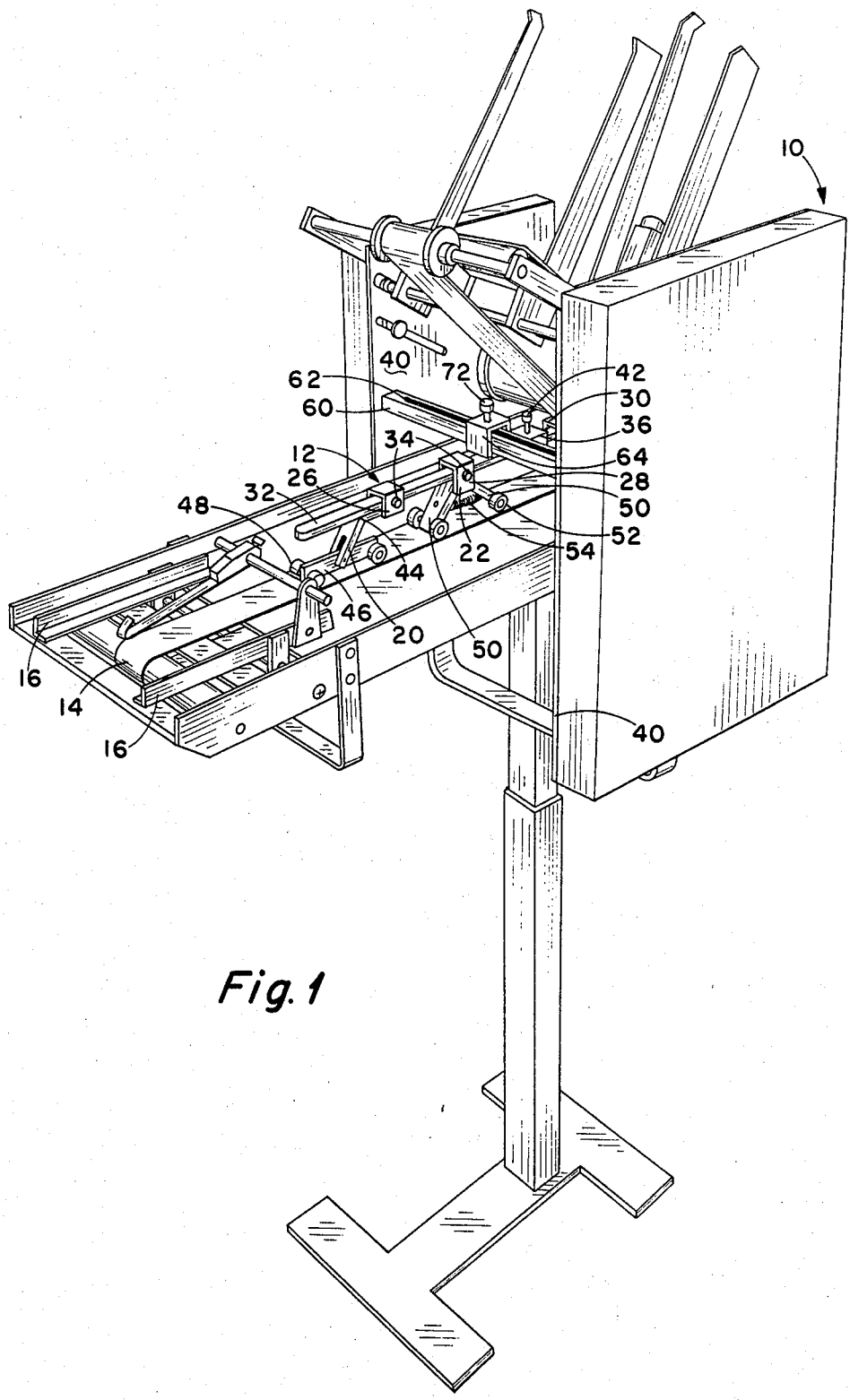
FIG. 1 is a perspective view of an envelope feeder showing the tension apparatus of the present invention.

Referring to FIG. 1, a feeder machine 10 is shown for feeding sheets of material, such as envelopes or the like, to an offset printer (not shown) of the type like duplicator Model No. 350 sold by the A. B. Dick Company. However the feeder machine 10 comprising the present invention (to be disclosed hereinafter) is not limited to the above printer. Feeder 10 is essentially the same in operation and design to the sheet feed machine (with the exception of the present invention) disclosed in U.S. Pat. No. 4,369,959 to Hornbuckle.

Referring to the drawings in detail, feeder 10 includes an intermediate conveyor mechanism 12 which holds a stream of sheets (not shown) down on top of a conveyor belt 14. Envelopes, for example, are fed into the space between a pair of guide members 16 over belt 14 and under conveyor mechanism 12. The conveyor mechanism comprises a plurality of hold down or roller assemblies 20, 22 and 24. Each roller assembly 20, 22 and 24 is provided with a mounting collar 26, 28 and 30 respectively, and each is slidably mounted by means of its respective collar to a bar or beam 32. The relative positions of collars 20, 22 and 24 are secured by means of thumb screws 34, which are threadedly received into a side portion of the collars.

Figure 2:
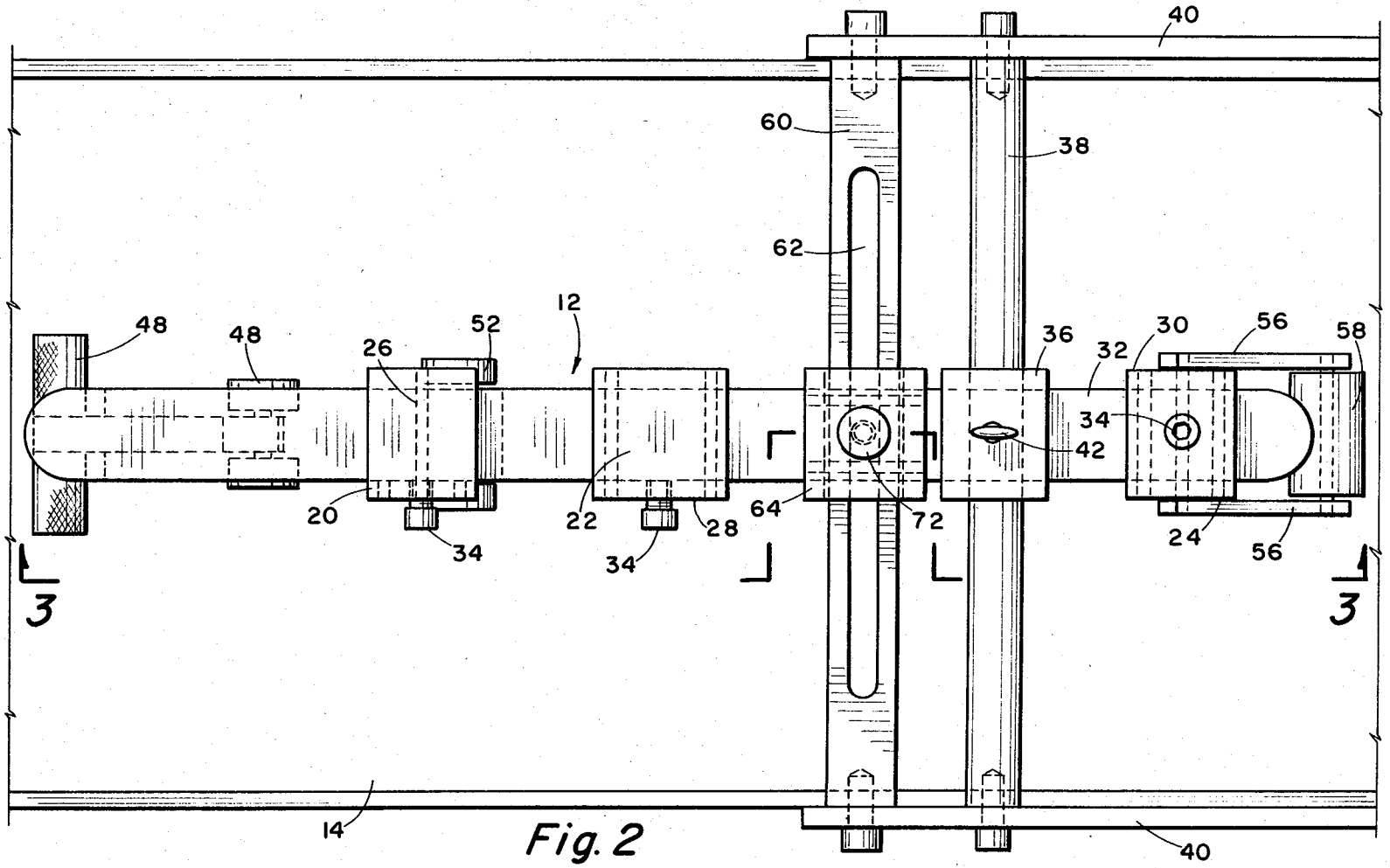
FIG. 2 is a top plan view of a portion of an envelope feeder showing the present invention in greater detail.
Figure 3:
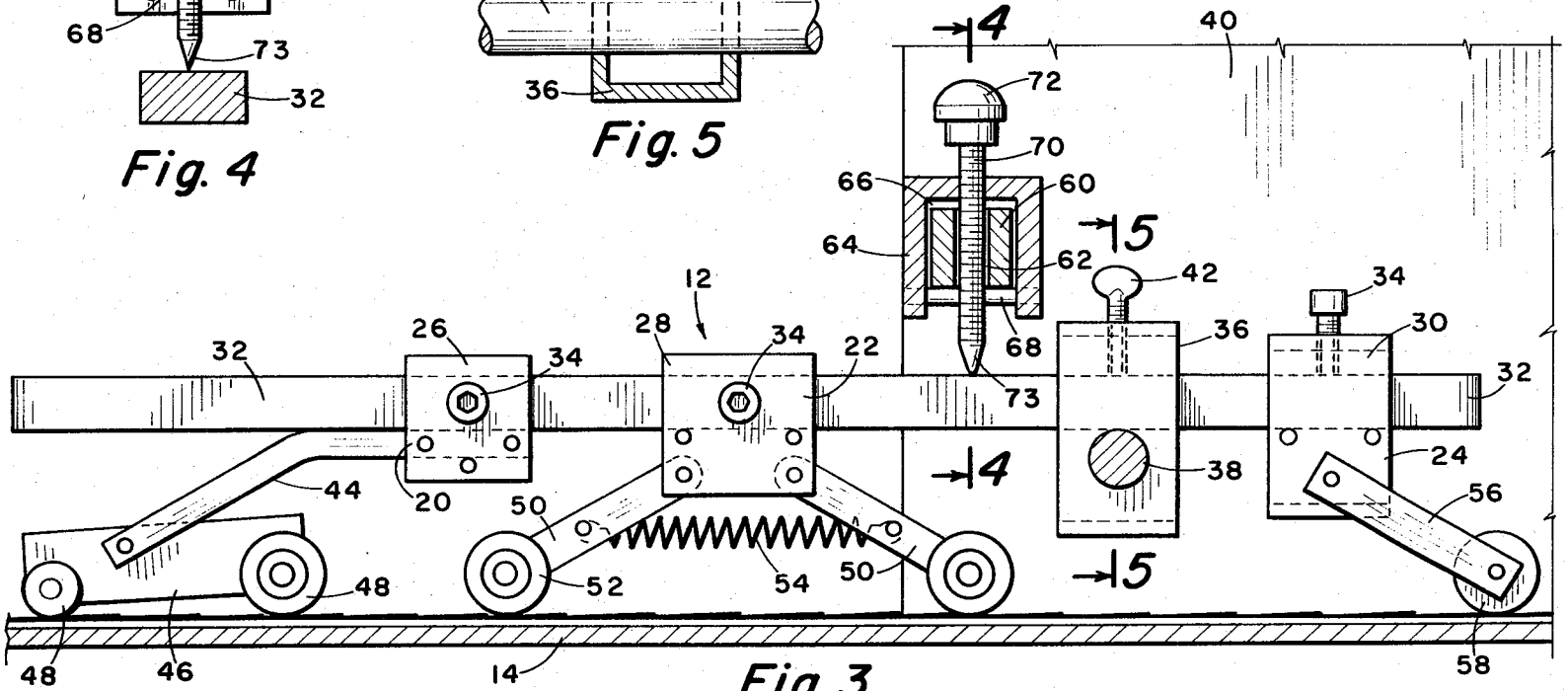
FIG. 3 is a side elevational view taken in cross-section along section line 3—3 of FIG. 2.
Figure 5:
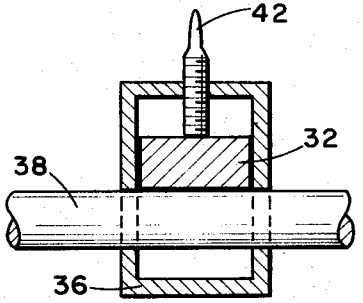
FIG. 5 is a cross-sectional view taken along section line 5—5 of FIG. 3.

Beam 32, as seen in FIGS. 2, 3 and 5 passes through a mounting bracket 36 which is pivotably mounted on a pivot rod 38. The pivot rod 38 extends between the interior side plates 40 of the feeder 10 so as to be disposed above and perpendicular to beam 32. As best shown in FIG. 5, the beam rests on top of pivot rod 38 and the bracket 36 is locked onto the rod by means of a securing screw 42.

Referring to FIG. 3, the forward roller assembly 20 comprises the slidably mounted collar 26 which supports an arm 44 to which a trolley 46 is pivotally mounted. A plurality of rollers 48 are rotatably mounted on the lower portion of trolley 46. The central roller assembly 22 comprises its slidably mounted collar 28 to which are pivotally mounted a pair of legs 50. Each leg 50 supports a pairs of rotatably mounted rollers 52 and the legs are linked by means of a coupling spring 54. The coupling spring provides the central roller assembly 22 with its own downward spring tension. Rear roller assembly 24 also comprises its slidably mounted collar 30 to which is pivotally mounted a pair of legs 56. Legs 56 are provided with a single roller 58 which extends between the lower ends of legs 56 and is rotatably mounted thereto.

Figure 4:
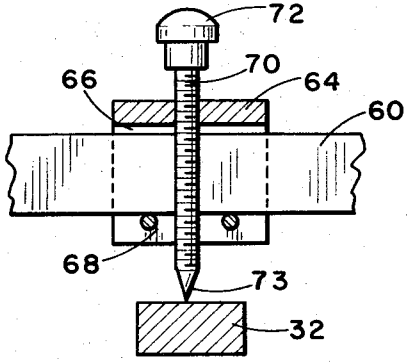
FIG. 4 is a cross-sectional view taken along section line 4—4 of FIG. 3.

Referring now to FIGS. 2, 3 and 4, the tension apparatus of the present invention comprises a tension bar 60 which extends between interior side plates 40 closely adjacent pivot rod 38. Bar 60 is parallel to the pivot rod and is disposed above and forward thereof. The tension bar is provided with a central opening or slot 62. A channel member 64, having a hollow rectangular cross-section 66, is slidably mounted on tension bar 60. Channel member 64 is provided with an opening 68 in its lower end which is disposed below central slot 62 of tension bar 60. An adjustment screw 70, having an external head 72, is threadedly received in the upper end of channel member 64.

As shown, the lower end 73 of adjustment screw 70 projects downwardly through slot 62 and against the upper surface of beam 32. The above arrangement exerts a downward pressure on the beam about the pivot axis provided by rod 38. By turning screw 70, the downward tension on front roller assembly 20 and rear roller assembly 24 can be adjusted.

What is claimed is:

1. An improved pressure adjustment device for an intermediate conveyor system of a sheet feed machine, said conveyor system comprising a plurality of spaced roller assemblies slidably mounted on a beam, said beam being disposed parallel to and above a conveyor belt, said conveyor belt being mounted on a horizontally disposed table which comprises a portion of a delivery station of said sheet feed machine, a mounting bracket received on said beam and being pivotally mounted on a pivot rod, said pivot rod extending between the interior side walls of said sheet feed machine and being secured thereto; said adjustment device comprising a horizontally disposed tension bar extending between said interior side walls in parallel relation to said pivot rod, said tension bar being located forward of and closely adjacent said pivot rod, a centrally disposed elongated slot in said tension bar, an attachment means slidably mounted on said tension bar, and an adjustment means received in said attachment means whereby said adjustment means exerts a downward pressure on said beam about said pivot rod.

2. An improved pressure adjustment device as set forth in claim 1 wherein said attachment means comprises a hollow channel member slidably mounted on said tension bar and having a lower opening therein being disposed beneath said elongated slot.

3. An improved pressure adjustment device as set forth in claim 2 wherein said adjustment means comprises a screw having an external head, said screw being threadedly received in the upper portion of said channel member and extending through said slot and said opening whereby the lower end of said screws projects downwardly against the upper surface of said beam.

* * * * *